United States Patent [19]

Tammerijn et al.

[11] Patent Number: 4,658,339

[45] Date of Patent: Apr. 14, 1987

[54] SPLASH-PROOF, DUST-PROOF VENTED LUMINAIRE

[75] Inventors: Franciscus M. Tammerijn; Hugo Van Der Woord, both of Winterswijk, Netherlands

[73] Assignee: U.S. Philips Corporation, New York, N.Y.

[21] Appl. No.: 804,706

[22] Filed: Dec. 4, 1985

[30] Foreign Application Priority Data

Dec. 10, 1984 [NL] Netherlands ..... 8403745

[51] Int. Cl.[4] ..... F21V 29/00

[52] U.S. Cl. ..... 362/294; 362/373

[58] Field of Search ..... 362/294, 218, 264, 267, 362/373, 362, 325; 361/383, 388

[56] References Cited

U.S. PATENT DOCUMENTS 3,555,267 11/1971 Sutter ..... 362/294

FOREIGN PATENT DOCUMENTS 2419091 11/1975 Fed. Rep. of Germany ..... 362/373
3300383 7/1984 Fed. Rep. of Germany ..... 362/373
2069120 8/1981 United Kingdom ..... 362/294

*Primary Examiner*—William A. Cuchlinski, Jr.
*Assistant Examiner*—D. M. Cox
*Attorney, Agent, or Firm*—David R. Treacy

[57] ABSTRACT

A luminaire housing which has a base portion closed in a water-tight manner by a cover which is at least in part transparent. The wall of the base portion has a venting opening located in the bottom of a depression. This depression has a side wall extending obliquely around the bottom, and an outwardly directed collar surrounding the venting opening. At an area located opposite to the venting opening, a wall portion of the cover is removable to provide a drainage opening. A labyrinth around the drainage opening on the inner side of the cover prevents any water and dust which may enter through the drainage opening from spreading through the housing.

12 Claims, 2 Drawing Figures

SPLASH-PROOF, DUST-PROOF VENTED LUMINAIRE

BACKGROUND OF THE INVENTION

The invention relates to a luminaire comprising a housing which accommodates a holder for an electric lamp. The housing has a base portion which is closed by a cover which is at least in part transparent, and a venting opening provided in the wall of the base portion.

Such a luminaire is known from German Gebrauchsmuster No. 1940617 and is frequently used to illuminate moist spaces. Due to the presence of venting openings, the temperature in the housing is prevented from increasing to an excessively high value during operation of a lamp arranged in the luminaire. In the housing of this luminaire, a comparatively large number of venting openings are provided through the base portion. These openings are in the form of slots formed in special spacer lugs, by means of which the housing can be secured to a ceiling. This construction, according to the Gebrauchsmuster, prevents water flowing into the housing, when the housing is secured to the ceiling. However, it has been found that, when such a luminaire is mounted on a wall in a position deviating from the horizontal, such as on a vertical wall, there is a risk nevertheless that water enters the housing and cannot escape.

This is especially disadvantageous in luminaires comprising a housing of comparatively small dimensions. It has been found that water and dust can then readily reach the current-conveying parts in the housing. Thus this known luminaire does not satisfy international standards with respect to water- and dusttightness (for example IP 54, as described in the document CIE 598-1 (1979)).

SUMMARY OF THE INVENTION

The invention has for its object to provide a luminaire in which, when secured either to a ceiling or to a vertical wall, the accessibility of water or dust is rendered difficult.

In accordance with the invention, in a luminaire of the kind mentioned in the opening paragraph a venting opening is provided in the bottom of an inward depression in the base portion. This depression has a side wall extending around the bottom, while the venting opening has an outwardly directed collar rising above the depression bottom. At an area located opposite to the venting opening, the cover has a wall portion which can be removed to provide a drainage opening. A labyrinth around the drainage opening, on the inner side of the cover, prevents any water and dust, which may enter through the drainage opening when the wall portion has been removed, from spreading through the housing.

The luminaire according to the invention provides, independently of the position in which it is mounted, a sufficient screening from penetration of dust and water. It satisfies the international requirements imposed with respect to dust- and watertightness. Due to the presence of the venting opening in the base portion, the seal between the base portion and the cover (which seal consists, for example, or a rubber ring) is prevented from being loaded by to a pressure difference between the air inside and outside the housing. If the base portion of the housing is secured to a vertical wall, venting is obtained through the opening in the base portion. The cover is then not provided with a drainage opening.

The presence of the collar around the venting opening and the wall of the depression, which is preferably slanted for easy manufacture, prevents water (or any other liquid), which might reach the depression in the base portion from entering the housing through the venting opening.

On the other hand, if the housing is secured to a generally horizontal ceiling, it is possible that water reaches the venting opening from the ceiling and enters the housing. When the luminaire is installed in this position, the removable portion in the housing then should be removed by the user to form a drainage opening. This wall portion may, for example, be a rubber plug or a frangible region in the cover. The water entering the base portion through the venting opening drops downwards and leaves the housing through the drainage opening located opposite to the venting opening. In order to prevent water or dust nevertheless spreading through the housing, the labyrinth or a similar screening is provided near the drainage opening. This labyrinth is preferably constructed as a set of walls extending from the depression in the base portion and from the cover. Thus, it is prevented that water or dust, entering through the vent opening, spreads from the cover portion surrounding the draining opening in the housing and reaches the current-conveying members located in this housing.

In a preferred embodiment of the luminaire according to the invention, a labyrinth screening around the drainage opening comprises a first tubular part which faces the base portion and is integral with the cover, and a second tubular part extending in the direction of the cover from around the venting opening in the base portion. The first tubular part has a larger diameter than the second tubular part and these tubular parts overlapping each other longitudinally, thereby forming an annular gap between the walls of the tubular parts. A tubular wall part is also to be understood herein to mean a wall portion which, for example, has a rectangular cross-section.

By a suitable choice of the dimensions of these tubular parts, it is prevented that water jets from the outside directed to the drainage opening reach the interior of the housing. Experiments have shown that water jets which are incident at an acute angle to the cover and which are directed with great force to the drainage opening do not penetrate into the space in the interior of the housing. The present embodiment further has the advantage that a satisfactory screening is obtained from dust penetrating through the openings.

In a particular embodiment of the luminaire according to the invention, the depression in the base portion, in which the venting opening is formed, is located in an inwardly offset part of the base portion, while a collar is present which surrounds the depression. Especially when the housing is secured to a ceiling, the possibility of water entering through the venting opening is further reduced.

The luminaire according to the invention preferably comprises a housing of synthetic material or of aluminum and is particularly suitable to receive a light source having comparatively small dimensions, such as a "PL" lamp (cf. for example German Offenlegungsschrift No. 3121077 to which U.S. Pat. No. 4,426,602 corresponds.

An embodiment of the luminaire according to the invention will be described more fully by was of example with reference to the accompanying drawing.

DESCRIPTION OF THE PREFERRED EMBODIMENT

Figure 1:
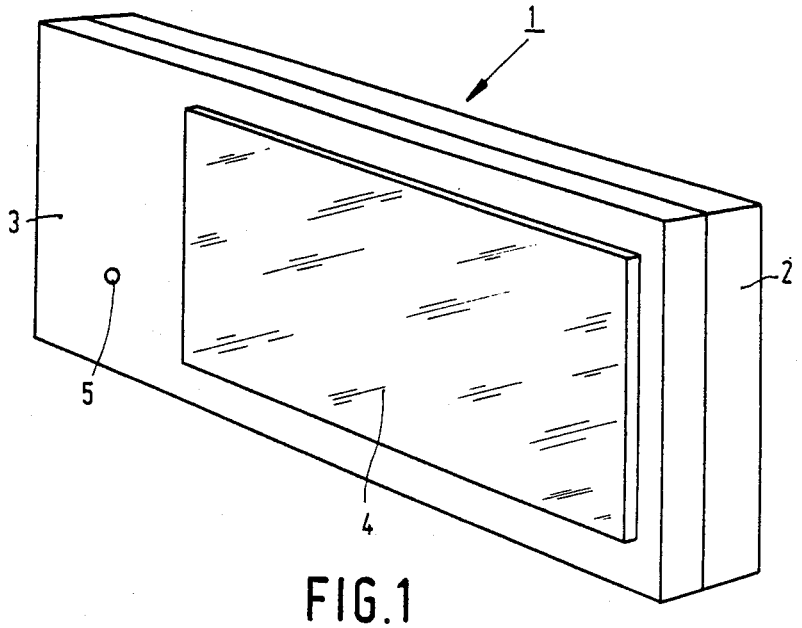
FIG. 1 is an elevation of a luminaire according to the invention.

The luminaire shown in FIG. 1 comprises a housing (1) of synthetic material having a base portion (2) which is closed in a water-tight manner by means of an elastic sealing ring or gasket 2*a* (cf. FIG. 2) and a cover 3, which comprises a transparent window 4. The housing further accommodates a holder for an electric lamp (not shown in the drawing). The lamp is, for example, a compact luminescent low-pressure mercury vapor discharge lamp, whose discharge vessel comprises two tube portions which are arranged beside and parallel to each other and are interconnected (cf. Offelegungsschrift No. 3121077 or U.S. Pat. No. 4,426,602). The housing further has room for an electric stabilization ballast, which is required for the operation of the lamp. The front wall of the cover 3 has a frangible region which can be removed by a user to form a drainage opening 5.

Figure 2:
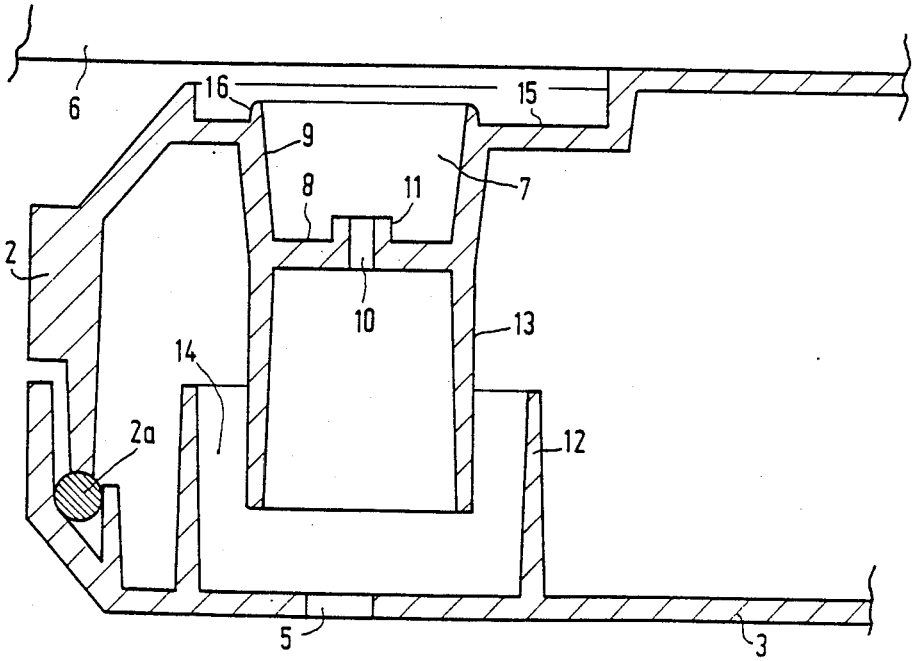
FIG. 2 is a longitudinal sectional view of the luminaire shown in FIG. 1 at the area of the venting opening, the luminaire being secured to a ceiling.

FIG. 2 shows the situation in which the housing of the luminaire is secured to a horizontal ceiling 6. The base portion 2 is provided with an inward depression 7 (of circular cross-section) having a bottom 8 with a sidewall 9 extending obliquely with respect thereto. The bottom 8 is provided with a venting opening 10 which has an outwardly directed collar 11. The cover 3 is provided with the drainage opening 5, which in this luminaire orientation is below the venting opening 10. In the situation shown in FIG. 2, the opening 5 is located substantially perpendicularly below the venting opening 10. The drainage opening 5 is obtained when the frangible region in the cover 3 is pushed away by the user. Near the drainage opening 5, a labyrinth of overlapped walls is provided on the inner side of the cover 3 in order to prevent any water and dust which may enter through opening 5 from spreading through the housing. Around the drainage opening 5, a first tubular part 12 is arranged, faces the base portion 2 and which is integral with the cover 3. A second tubular part 13 extends from a region around the venting opening 10 towards the cover. The tubular part 13 is integral with the base portion 2 and also consists of synthetic material. The tubular parts 12 and 13 have different diameters (the inner diameter of 13 is smaller than that of 12), and overlap to form an annular gap 14. As appears from FIG. 2, the ratio between the diameters of these tubular parts and the extent to which they overlap each other are chosen so that even a high velocity water jet which is directed into the opening 5 from the outside at an oblique angle, is still screened. In this construction, water and dust are prevented from spreading through the housing.

The depression 7 in the base portion 2, in which the venting opening 10 is formed, is located in an inwardly offset part 15 of the outer wall of the base portion. A cylindrical upright edge 16 is present around the depressions 7. As a result the possibility of water flowing into the housing through the venting opening 10 is further reduced. In the case in which, besides the upright edge 16, also the collar 11 in the depression 7 is overflown by water, a further spread thereof through the housing need not be feared. In fact the water then drops downwards and reaches the space which is bounded by the cylinder 12 and the hood 3 and is provided at its lower side with the drainage opening 5. This opening is preferably larger than the venting opening 10. A satisfactory drainage of the water is then guaranteed.

As appears from the construction of the base portion, during operation in a vertical position, the venting opening 10 is not closed by water. This is prevented due to the oblique sidewall 9 and due to the collars 11 and 16. The water flows away over the oblique sidewall 9 and the gap between the ceiling and the end of the base portion.

In a practical embodiment, the housing of the luminaire has a length of about 40 cm, and a width of about 15 mm. The inner diameter of the tubular part 13 is 16 mm and that of the tubular part 12 is about 29 mm. The height of the tubular part 12 is 17 mm and that of the tubular part 13 is about 20 mm. These tubular parts overlap each other by 11 mm. In the state in which the outer side of the base portion is secured to the ceiling by means of screws, for example, the botton of the depression is located about 10 mm below this ceiling. The collar 16 has a height of 1.5 mm. The wall portion 15 is located 6 mm below the ceiling. This luminaire satisfies the water- and dust-tightness standard IP54 according to CIE-598-1.

What is claimed is:

1. A luminaire having a housing which accommodates a holder adapted to receive an electric lamp, said housing comprising:

a base portion having a wall with a venting opening formed therein, and a cover which is transparent at least in part, said base portion and cover being closed in a water-tight manner, characterized in that said base portion has an inward depression having a bottom, said venting opening being located in said bottom; said depression having a side wall extending around said bottom, and said opening having an outwardly directed collar, and at an area located opposite the venting opening, said cover has a removable wall portion which, upon removal, provides a drainage opening on the inner side of the cover; and means for preventing any water and dust, which may enter through the drainage opening when the wall portion is removed, from spreading through the housing.

2. A luminaire as claimed in claim 1, characterized in that said means is a wall system which forms a labyrinth.

3. A luminaire as claimed in claim 2, characterized in that said wall system comprises a first tubular part which faces the base portion and is integral with the cover, and a second tubular part around the venting opening in the base portion, extending towards the cover, the first tubular part having a larger diameter than the second tubular part; and in that these tubular parts overlap each other longitudinally and are arranged to form an annular gap therebetween.

4. A luminaire as claimed in claim 3, characterized in that said base portion has an inwardly offset part in which said venting opening is located, and a collar on said offset part surrounding said depression.

5. A luminaire as claimed in claim 4, characterized in that the drainage opening in the cover is larger than the venting opening in the base portion.

6. A luminaire as claimed in claim 3, characterized in that the drainage opening in the cover is larger than the venting opening in the base portion.

7. A luminaire as claimed in claim 2, characterized in that the drainage opening in the cover is larger than the venting opening in the base portion.

8. A luminaire as claimed in claim 2, characterized in that said base portion has an inwardly offset part in which said venting opening is located, and a collar on said offset part surrounding said depression.

9. A luminaire as claimed in claim 8, characterized in that the drainage opening in the cover is larger than the venting opening in the base portion.

10. A luminaire as claimed in claim 1, characterized in that said base portion has an inwardly offset part in which said venting opening is located, and a collar on said offset part surrounding said depression.

11. A luminaire as claimed in claim 10, characterized in that the drainage opening in the cover is larger than the venting opening in the base portion.

12. A luminaire as claimed in claim 1, characterized in that the drainage opening in the cover is larger than the venting opening in the base portion.

* * * * *